US006450110B1

(12) United States Patent
Brühl et al.

(10) Patent No.: US 6,450,110 B1
(45) Date of Patent: Sep. 17, 2002

(54) SEWING MACHINE WITH SPEED-DEPENDENT STITCH CORRECTION

(75) Inventors: Lother Brühl, Otterbach; Edgar Butzen; Karl-Ludwig Manuel, both of Landstuhl, all of (DE)

(73) Assignee: G.M. Pfaff Aktiengesellschaft (DE)

( * ) Notice: Subject to any disclaimer, the term of this patent is extended or adjusted under 35 U.S.C. 154(b) by 0 days.

(21) Appl. No.: 09/837,976

(22) Filed: Apr. 19, 2001

(30) Foreign Application Priority Data

Apr. 20, 2000 (DE) ..... 100 19 921

(51) Int. Cl.[7] ..... D05B 19/00; D05B 27/22
(52) U.S. Cl. ..... 112/470.01; 112/275; 112/315
(58) Field of Search ..... 112/470.01, 275, 112/277, 313, 314, 303, 315

(56) References Cited

U.S. PATENT DOCUMENTS 4,495,877 A 1/1985 Willenbacher
4,548,143 A 10/1985 Martell et al.
4,706,584 A * 11/1987 Senda et al. ..... 112/275 X
4,858,545 A 8/1989 Balke et al.
5,280,758 A * 1/1994 Muller ..... 112/470.01
5,771,828 A 6/1998 Arnold

FOREIGN PATENT DOCUMENTS

DE 32 16 993 A1 11/1983
DE 36 17 204 C1 10/1987
DE 38 04 920 A1 9/1988
DE 196 15 308 C1 7/1997

* cited by examiner

*Primary Examiner*—Peter Nerbun
(74) *Attorney, Agent, or Firm*—McGlew and Tuttle, P.C.

(57) ABSTRACT

In a sewing machine, the speed-dependent change in the stitch length is compensated by a speed-dependent correction of the setting of the stitch regulating device. A linear stitch length desired value curve Ss is obtained.

20 Claims, 1 Drawing Sheet

SEWING MACHINE WITH SPEED-DEPENDENT STITCH CORRECTION

FIELD OF THE INVENTION

The present invention pertains to a sewing machine with at least one feed device a stitch regulating device, an adjusting device for the stitch regulating device, a pulse generator detecting the speed and the angular position of a machine shaft, and a computer, which controls the adjustment of the stitch regulating device by means of the adjusting device.

BACKGROUND OF THE INVENTION

It has been known from DE 32 16 993 C3 (U.S. Pat. No. 4,495,877) that the accuracy of positioning of the needle at the end point of the seam can be increased by determining the difference between the desired amount and the actual value of the feed of the feed device by means of a scanning device responding to the passage of the edge of the workpiece and taking this into account in the calculation for setting the stitch regulating device. U.S. Pat. No. 4,495,877 is hereby incorporated by reference. Aside from the fact that such a scanning device, which has at least two sensors arranged at mutually spaced locations from one another, is complicated, there may be inaccuracies during the scanning operation during sewing along curved workpiece edges, e.g., in the case of shirt collars, because of the rotary movement of the workpiece, and these inaccuracies distort the result of the measurement.

It was found that a very essential cause of the observed deviations between the set amount of feed and the actual amount of feed of the workpiece is that the amount of feed of the workpiece per stitch formation operation increases, in general, continuously with increasing speed of the machine, so that the stitch length becomes greater and greater. This feed behavior is taken into account in the sewing machine known from U.S. Pat. No. 4,548,143 by calculating the number of remaining sewing stitches as a function of the machine speed occurring at the time of recognition of the edge. Due to this measure, the speed-dependent changes in stitch length are said not to be able to lead to inaccurate results any more. However, this type of compensation of the speed-dependent changes in stitch length can be used only in processes for moving to a predetermined end point of a seam in which a partial amount of the stitch length is taken into account during the last stitch only.

A sewing machine with a device for measuring the actual feed length of the feed dog has been known from DE 36 17 204 C1 (corresponding to U.S. Pat. No. 4,458,545). Aside from the fact that such a measuring device and the associated signal processing device are comparatively complicated and disturbing effects, e.g., vibrations, may distort the results of the measurement, there is additionally a stitch length deviation which arises from the very principle due to the fact that the measurement of the actual stitch length is carried out at a markedly higher speed and consequently at a greater deviation between the desired value and the actual value of the stitch length than subsequently the formation of the last stitch.

SUMMARY AND OBJECTS OF THE INVENTION

The basic object of the present invention is to provide a sewing machine in which compensation of the speed-dependent changes in stitch length is made possible.

According to the invention, a sewing machine is provided with at least one feed device, with a stitch regulating device, with an adjusting device for the stitch regulating device, with a pulse generator detecting the speed and the angular position of a machine shaft, and with a computer. The computer controls the adjustment of the stitch regulating device by way of the adjusting device. Speed-dependent correction values can be sent to the stitch regulating device.

The present invention is based essentially on the idea of directly counteracting the changes in the effective stitch length arising at higher speeds compared with the set stitch length by a corresponding correction of the setting of the stitch regulating device, so that the changes in stitch length will not appear at all and therefore they do not have to be compensated by measures to be taken subsequently, either. This makes it possible to obtain a more accurate result in all seam sections in which sewing is performed with stitch counting.

In a sewing machine with a device for moving to a predetermined end point of a seam at a spaced location from the edge of a workpiece, a disturbance variable, which would otherwise have an especially strong effect, is eliminated by the compensation according to the present invention of the speed-dependent changes in the stitch length during the sewing of the remaining stitches after the recognition of an edge. Thus, the actual stitch length of the remaining stitches of the seam comes very close to the calculated stitch length, as a result of which a comparatively high accuracy of positioning of the needle at the end point of the seam is achieved.

By taking into account the speed-dependent correction values, the speed-dependent correction values may be stored in the form of a table in a memory and can be read by a computer, to also immediately initiate the proper correction of the stitch length setting already at the beginning of a speed change. Circumventing the measure disclosed in DE 38 04 920 A1, according to which the speed is reduced to a lower value several stitches before the end of the seam, this makes it now possible to continuously reduce the speed to zero in the manner described in DE 196 15 308 C1, and it is guaranteed that the actual length of all remaining whole stitches corresponds to the set stitch length.

The accuracy of a stitch length control and the accuracy of positioning of the needle at the end point of the seam are further increased by determining the value of the generally nonlinear adjustment characteristic of the stitch regulating device and taking it also into account as stitch length-related correction values.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
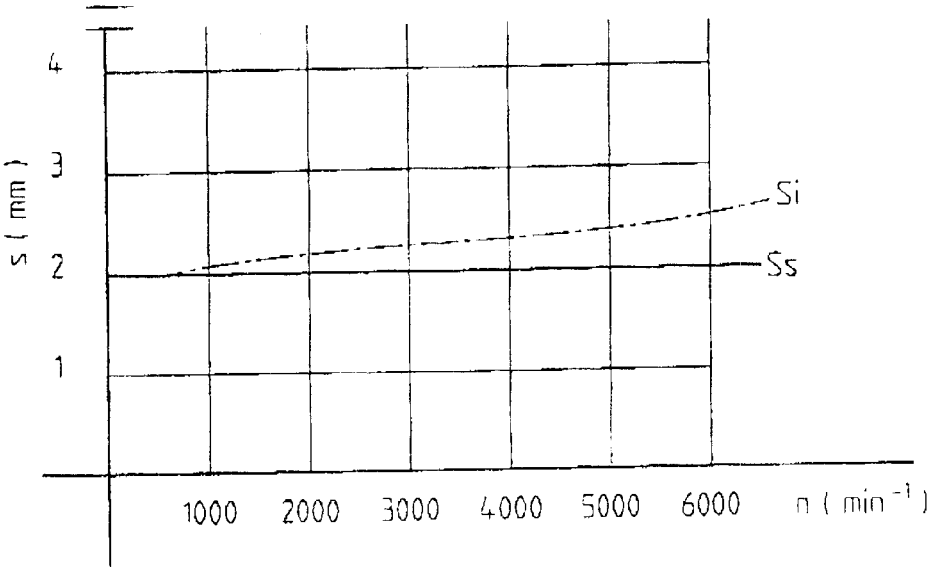
FIG. 1 is a diagram with a speed-dependent stitch length characteristic.
Figure 2:
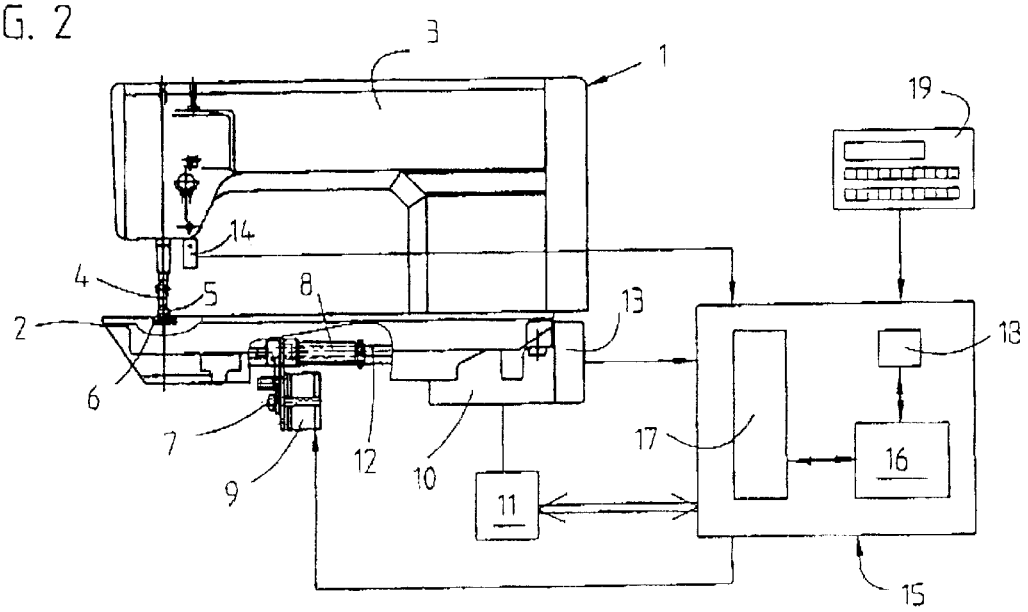
FIG. 2 is a side view of a sewing machine with a schematic block diagram of the control device.

Referring to the drawings in particular, a sewing machine 1 is shown with a base plate designated by 2 and the upper housing by 3. A needle bar 4 can be moved up and down. The needle bar 4 with the needle 5 is mounted in the head of the upper housing 3. A shuttle, not shown, cooperates with the needle 5 the known manner.

A feed dog 6 is arranged in the base plate 2. In the sewing machine disclosed in U.S. Pat. No. 4,495,877, which was cited in the introduction, the feed dog 6 corresponds to the feed dog designated by 25 there. The drive device of the feed dog 6 likewise corresponds to that of the feed dog 25 in U.S. Pat. No. 4,495,877 and thus it contains a stitch regulating device 7, which is designed, just as in the prior-art sewing machine, as a hinged stitch regulator. An adjusting shaft 8, which corresponds to the adjusting shaft 42 in the prior-art sewing machine, is associated with the stitch regulating device 7. The adjusting shaft 8 is directly connected to a stepping motor 9 used as an adjusting device.

A positioning motor 10 is arranged in the base plate 2. The positioning motor 10 with a control 11 is used to drive the sewing machine. The positioning motor 10 drives, among other things, a drive shaft 12 for the feed dog 6 in a manner not specifically shown. A pulse generator 13, which is used to detect the speed of the sewing machine 1 and the angular position of the drive shaft 12 when a workpiece edge passes through the light beam of a light barrier, is arranged at the positioning motor 10. The light barrier is represented only by a sensor 14 arranged at the head of the upper housing 3. The pulse generator 13 is also used in the known manner to detect the complete revolutions of the drive shaft 12 for performing stitch counting.

The control device includes a computer 15, which comprises essentially a processor 16, an I/O member 17 and at least one EPROM 18. The computer 15 is connected to a control panel 19.

The diagram in FIG. 1 shows how the stitch length S in mm becomes greater and greater with increasing speed n in rpm of the sewing machine with unchanged setting of the stitch regulating device 7 and increases from, e.g., 2 mm in the lower speed range of 1 to 500 rpm to about 2.5 mm at n=6,000 rpm. This feed behavior appears, in general, in all sewing machines, but it may differ from one type of machine to the next.

To compensate this speed-dependent change in stitch length, which is represented in the actual value curve Si, the correction value K1, which is necessary for each stitch length S and each speed n, is determined by measurements for each type of machine and each series of machines; this correction value K1 is the correction value with which the setting of the stitch regulating device 7 must be changed in order to obtain a corrected actual value curve Ss for which the stitch length St actually performed always corresponds to the set stitch length Se in the entire speed range. These correction values K1 are stored in the form of a table in the EPROM 18.

Furthermore, the speed-independent adjustment characteristic of the stitch regulating device 7, i.e., the stitch length set values of the stitch regulating device 7 which are obtained at constant angle adjustment increments of the adjusting shaft 8 and which are, in general, nonlinear and may differ more substantially especially in the case of a change in the direction of feed, is determined by measurements for each series of machines. To compensate this nonlinearity, a correction value K2, with which the setting of the stitch regulating device 7 must be changed in order to obtain a uniform change in the set stitch length S for each equal angular adjustment of the adjusting shaft 8, i.e., for each angle increment that can be performed by the stepping motor 9, is determined for each stitch length setting value. These speed-independent correction values K2 are likewise stored in the EPROM 18 in the form of a table.

During the operation of the sewing machine 1, the computer 15 reads the correction value K2 associated with the set stitch length S as well as the correction value K1 associated with the current speed n from the EPROM 18 and calculates from them a corrected manipulated variable for the stepping motor 9, with which the stepping motor will adjust the stitch regulating device 7 such that the stitch length St actually performed will correspond to the set stitch length Se at any speed.

Based on this compensation of the speed-dependent changes in stitch length which otherwise occur, it is now possible to form each seam with stitch lengths which are always equal. Furthermore, highly accurate control of the seam length can be performed even over long seam sections by means of the stitch counting performed by the pulse generator 13.

Above all, the needle 5 is now introduced accurately in the position calculated in advance even when the final stitch of a seam is formed, without a desired value-actual value comparison of the amount of feed of the workpiece being first required. Movement to the predetermined end point of a seam is thus performed much more simply than in the sewing machine according to DE 32 16 993 C3 and U.S. Pat. No. 4,495,877 cited in the introduction. Moreover, improved accuracy is achieved, because the possibilities of error, which cannot be ruled out in the prior-art sewing machine during the determination of the difference between the desired value of the feed and the actual value of the feed, cannot occur during the compensation of the speed-dependent changes in the stitch length, which depend on the adjustment characteristic of the stitch regulating device 7.

While a specific embodiment of the invention has been shown and described in detail to illustrate the application of the principles of the invention, it will be understood that the invention may be embodied otherwise without departing from such principles.

What is claimed is:

1. A sewing machine, comprising:

a feed device;

a stitch regulating device;

an adjusting device for the stitch regulating device;

a pulse generator detecting the speed and the angular position of a machine shaft; and a computer for controlling the adjustment of the stitch regulating device by said adjusting device, said computer sending speed-dependent correction values to said stitch regulating device.

2. A sewing machine in accordance with claim 1, further comprising:

a moving device for moving to a predetermined end point of a seam at a spaced location from the edge of a workpiece, said moving device including a sensor arranged in front of the needle to trigger the operation for positioning the needle in the end point of the seam during the passage of the edge of the workpiece, said computer determining a number of remaining stitches as a function of a distance between the needle and the sensor and an angular position of the machine shaft, which angular position is determined at the time of the recognition of the edge, said speed-dependent correction values being sent to said stitch regulating device at least also during the formation of the remaining stitches.

3. A sewing machine in accordance with claim 1, further comprising a memory wherein said speed-dependent correction values are stored in said memory in the form of a table, wherein said speed-dependent correction values can be read by said computer.

4. A sewing machine in accordance with claim 2, further comprising a memory wherein said speed-dependent correction values are stored in said memory in the form of a table, wherein said speed-dependent correction values can be read by said computer.

5. A sewing machine in accordance with claim 1, further comprising a memory wherein stitch length-related values of the adjustment characteristic of said stitch regulating device are stored in the form of a table in said memory and said speed-dependent correction values and said stitch length-related values of the adjustment characteristic can be linked with one another in said computer.

6. A variable frequency sewing machine, comprising:

a feed device having a feed device motion, said feed device motion resulting in a corresponding advancement increment of a material being acted upon by said feed device, said increment determining a stitch spacing of stitches made in said material by the sewing machine, wherein a ratio of said feed device motion to said advancement increment varies in a non-linear manner with respect to the sewing machine frequency;

a stitch regulating device to regulate said feed device motion;

an adjusting device for adjusting said stitch regulating device;

a pulse generator for generating frequency signals corresponding to the frequency of the sewing machine; and a controller for controlling the adjustment of said stitch regulating device by said adjusting device, said controller receiving said frequency signals from said pulse generator and sending frequency dependent adjustment values to said stitch regulating device to achieve a desired stitch spacing at variable sewing machine frequencies.

7. A variable frequency sewing machine in accordance with claim 6, further comprising:

a moving device for moving to a predetermined end point of a seam at a spaced location from an edge of a workpiece, said moving device including a sensor arranged in front of a needle to trigger an operation for positioning the needle in the end point of the seam during passage of the edge of the workpiece, said controller determining a number of remaining stitches as a function of a distance between the needle and the sensor and an angular position of a machine shaft, which angular position is determined at a time of recognition of the edge, said frequency dependent adjustment values being sent to said stitch regulating device at least also during formation of the remaining stitches.

8. A variable frequency sewing machine in accordance with claim 6, further comprising:

a memory wherein said frequency dependent adjustment values are stored in said memory in the form of a table, wherein said frequency dependent adjustment values can be read by said controller.

9. A variable frequency sewing machine in accordance with claim 7, further comprising:

a memory wherein said frequency dependent adjustment values are stored in said memory in the form of a table, wherein said frequency dependent adjustment values can be read by said controller.

10. A variable frequency sewing machine in accordance with claim 6, further comprising:

a memory wherein stitch length-related values of an adjustment characteristic of said stitch regulating device are stored in the form of a table in said memory and said frequency dependent adjustment values and said stitch length-related values of the adjustment characteristic can be linked with one another in said controller.

11. A sewing machine, comprising:

a needle bar;

a feed element for contacting and feeding a material to be sewn in an advancement increment;

a transmission having a rotating shaft;

a positioning motor for driving the feed element and the needle bar through said transmission;

a stitch regulating device for changing the relationship between the advancement increment and the needle bar movement, the relationship between the advancement increment and a movement of said feed element being non-linear with regard to the operation speed of the positioning motor;

an adjusting device acting on said stitch regulating device to change the relationship between the advancement increment and the needle bar movement;

a measuring means for measuring said operation speed; and a control means for controlling said adjusting device to control said stitch regulating device as a function of the operation speed of the positioning motor to maintain a desired stitch spacing as the operation speed varies.

12. A sewing machine in accordance with claim 11, further comprising:

a moving device for moving to a predetermined end point of a seam at a spaced location from an edge of a workpiece, said moving device including a sensor arranged in front of a needle to trigger an operation for positioning the needle in the end point of the seam during passage of the edge of the workpiece, said control means determining a number of remaining stitches as a function of a distance between the needle and the sensor and an angular position of said rotating shaft, which angular position is determined at the time of the recognition of the edge.

13. A sewing machine in accordance with claim 11, further comprising:

a memory wherein speed-dependent correction values are stored in said memory in the form of a table, wherein said speed-dependent correction values can be read by said control means.

14. A sewing machine in accordance with claim 12, further comprising:

a memory wherein speed-dependent correction values are stored in said memory in the form of a table, wherein said speed-dependent correction values can be read by said control menas.

15. A Sewing machine in accordance with claim 11, further comprising:

a memory wherein stitch length-related values of an adjustment characteristic of said stitch regulating device are stored in the form of a table in said memory and speed-dependent correction values and said stitch length-related values of the adjustment characteristic can be linked with one another in said control means.

16. A sewing machine, in accordance with claim 1:

wherein said computer for controlling the adjustment of the stitch regulating device by said adjusting device maintains a uniform stitch spacing at varying speeds of said machine shaft.

17. A sewing machine in accordance with claim 16, further comprising:

a moving device for moving to a predetermined end point of a seam at a spaced location from an edge of a workpiece, said moving device including a sensor arranged in front of a needle to trigger an operation for positioning the needle in the end point of the seam during passage of the edge of the workpiece, said computer determining a number of remaining stitches as a function of a distance between the needle and the sensor and an angular position of the machine shaft, which angular position is determined at a time of recognition of the edge, said speed-dependent correction values being sent to said stitch regulating device at least also during formation of the remaining stitches.

18. A sewing machine in accordance with claim 16, further comprising:

a memory wherein said speed-dependent correction values are stored in said memory in the form of a table, wherein said speed-dependent correction values can be read by said computer.

19. A sewing machine in accordance with claim 17, further comprising:

a memory wherein said speed-dependent correction values are stored in said memory in the form of a table, wherein said speed-dependent correction values can be read by said computer.

20. A Sewing machine in accordance with claim 16, further comprising:

a memory wherein stitch length-related values of an adjustment characteristic of said stitch regulating device are stored in the form of a table in said memory and said speed dependent correction values and said stitch length-related values of the adjustment characteristic can be linked with one another in said computer.

* * * * *